US007217155B2

(12) United States Patent
Montena

(10) Patent No.: US 7,217,155 B2
(45) Date of Patent: May 15, 2007

(54) COMPRESSION CONNECTOR FOR BRAIDED COAXIAL CABLE

(75) Inventor: Noah Montena, Syracuse, NY (US)

(73) Assignee: John Mezzalinaqua Associates, Inc., East Syracuse, NY (US)

( * ) Notice: Subject to any disclaimer, the term of this patent is extended or adjusted under 35 U.S.C. 154(b) by 18 days.

(21) Appl. No.: 11/317,704

(22) Filed: Dec. 23, 2005

(65) Prior Publication Data

US 2006/0194474 A1 Aug. 31, 2006

Related U.S. Application Data

(63) Continuation-in-part of application No. 11/092,197, filed on Mar. 29, 2005, now Pat. No. 7,048,579, which is a continuation-in-part of application No. 10/892,645, filed on Jul. 16, 2004, now Pat. No. 7,029,326.

(51) Int. Cl.
*H01R 9/05* (2006.01)

(52) U.S. Cl. ..... 439/578; 439/584

(58) Field of Classification Search ..... 439/578–585
See application file for complete search history.

(56) References Cited

U.S. PATENT DOCUMENTS 5,154,636 A 10/1992 Vaccaro et al.
5,284,449 A 2/1994 Vaccaro
5,632,651 A * 5/1997 Szegda ..... 439/578
5,795,188 A 8/1998 Harwath
5,830,009 A * 11/1998 Tettinger ..... 439/578
5,944,556 A 8/1999 Wlos et al.
6,019,635 A 2/2000 Nelson
6,293,824 B1 9/2001 Guerin et al.
6,619,876 B2 9/2003 Vaitkus et al.
6,733,336 B1 5/2004 Montena et al.
6,840,803 B2 1/2005 Wlos et al.
6,884,113 B1 4/2005 Montena
6,939,169 B2 9/2005 Islam et al.

* cited by examiner

*Primary Examiner*—Michael C. Zarroli
(74) *Attorney, Agent, or Firm*—Wall Marjama & Bilinski LLP

(57) ABSTRACT

A coaxial cable compression connector for interconnecting braided coaxial cable to a trunk line equipment port is provided, wherein the connector is connected to a trunk line equipment port, a segment of cable is inserted within the connector, and the cable is caused to be radially compressed within the connector so as to provide an inexpensive, reliable and permanent connection between the braided coaxial cable and the connector without the usage of an adapter or a swivel joint.

23 Claims, 9 Drawing Sheets

COMPRESSION CONNECTOR FOR BRAIDED COAXIAL CABLE

CROSS-REFERENCE TO RELATED APPLICATIONS

This application is a continuation in part of U.S. application Ser. No. 11/092,197 filed Mar. 29, 2005 now U.S. Pat. No. 7,048,579, which is a continuation of part of U.S. application Ser. No. 10/892,645 filed Jul. 16, 2004 now U.S. Pat. No. 7,029,326, which are all incorporated by reference.

FIELD OF THE INVENTION

The present invention relates generally to coaxial cable connectors, and more particularly to coaxial cable connectors for providing a reliable connection between braided coaxial cable and trunk line equipment ports without adding unnecessary cost and complexity or negatively affecting network performance.

BACKGROUND OF THE INVENTION

Coaxial cable is a typical transmission medium used in modern communications networks, such as CATV networks. The bulk of such networks are generally formed of standard "hard-line" coaxial cable, which includes a rigid or semi-rigid outer conductor and is typically covered with a weather protective jacket. Such a design effectively prevents radiation leakage and signal loss plus provides excellent physical protection (i.e., shielding) to the sensitive inner conductor and dielectric portions of the cable. Thus, it is customary to use standard hard-line coaxial cable to span at least the long, generally straight distances along the transmission portion of the network where leakage and signal loss would be more difficult to diagnose and where the negative effects thereof could more greatly affect the communications networks as a whole.

However, standard hard-line coaxial cable is quite costly and somewhat difficult to install as compared to large gauge, braided coaxial cable, such as RG11 type cable. Such cable typically includes a central conductor surrounded by a dielectric core which is surrounded by one or more layers of metal foil which is surrounded by a metal braided or wire mesh outer conductor, which is in turn surrounded by a protective outer jacket. Although such braided coaxial cable does not provide the level of physical protection afforded by standard hard-line coaxial cable, it is comparatively more structurally flexible. Thus, there are benefits to utilizing braided coaxial cable within a communications network wherever its inexpensive cost and structural flexibility would outweigh its comparative lack of physical protection versus standard hard-line coaxial cable.

Realizing this, many telecommunications and cable companies already utilize or would like to utilize the flexible, inexpensive braided coaxial cable on a widespread basis, such as, at minimum, to bend around physical obstacles at or near the actual locations (e.g., residences, businesses) to which their communication network signals are being delivered.

In order to maintain the electrical integrity of the communications network signals, it is critical that the braided coaxial cable, when used, be securely interconnected to the ports of the trunk line equipment that distributes and/or conditions such signals without disrupting the ground connection of the cable. Making this interconnection can be difficult, however, because the ports of most trunk line equipment have a "KS" type connection/interface, which is designed to be compatible with standard hard-line cable and equipment, whereas flexible coaxial cable having a braided outer conductor generally uses an "F" type connection/interface which is incompatible with the KS type ports.

One solution to this problem is to utilize an adapter to connect the incompatible "KS" and "F" connections; however, doing so adds non-nominal assembly costs, requires the workmanship of a skilled technician, and, even if such adapters are installed correctly, can compromise overall communications network performance. Another option is to use a specially fashioned hard-line coaxial cable connector, such as a threaded, crimped or compression coaxial cable connector. But use of such connectors with braided coaxial cable is not ideal for various reasons, including incompatibility, difficulty of installation and negative performance effects.

Thus, there is a need for a device that can provide an effective connection between braided coaxial cable and trunk line equipment ports without requiring the use of an adapter, incurring undue expense, negatively affecting system performance, or unduly complicating the installation process.

SUMMARY OF THE INVENTION

These and other needs are met by the present invention, which provides a device (e.g., a connector) for interconnecting coaxial cable of a communications network to a trunk line equipment port. By way of non-limiting example, the coaxial cable can be braided coaxial cable, such as RG11 or other large gauge braided coaxial cable. Also by way of non-limiting example, the communications network can be a computer, cable or telecommunications network (e.g., a CATV network or the like). Still also by way of non-limiting example, the trunk line equipment to which the cable is connected can be a tap, an amplifier, a filter, a trap, or the like, wherein the equipment port has a particular port interface, e.g., a "KS" type of port interface.

In accordance with one or more exemplary embodiments of the present invention, the device is configured for interconnecting a segment of braided coaxial cable to an equipment port. To that end, the connector includes a connector body defining an internal bore and having a first end and a second end, wherein the first end of the connector body has a port interface (e.g., a "KS" type port interface) and wherein the second end of the connector body includes one or more external ridges for engagement with a compression tool and an internal groove. Optionally, the internal bore of the body can have a diameter that varies in stepped or tapered fashion between the first and second ends of the connector body.

Still in accordance with one or more exemplary aspects of the present invention, the device further includes a post having a first end and a second end. The first end of the post is sized and configured for engagement with the connector body at a portion of the internal bore. The second end of the post includes a sleeve configured for engagement with at least the braided outer conductor of the coaxial cable. Typically the sleeve is inserted between the dielectric core and the braided outer conductor. However, other configurations are known in the art wherein the second end of the post abuts the metal foil layer or braided outer conductor as it is folded back over the protective outer jacket of the coaxial cable. The sleeve may include one or more serrations, barbs or tapers to assist the engagement of the braided outer conductor.

In still further accordance with one or more exemplary aspects of the present invention, the device further includes a compression member that has a first end, a second end, an inner surface and an outer surface. The first end of the compression member may include an external protruding rib that is sized and configured to engage the groove on the internal groove at the second end of the connector body to retain the compression member in a first position wherein the second end of the compression member and connector body is capable of receiving a prepared end of the coaxial cable. Alternatively, the first end of the compression member may be sized to be press fit into the second end of the connector body. The second end of the compression member typically includes a flange which is configured to engage with a compression tool (not shown) which slidably axially advances the compression member further into the connector body. The force of the compression tool is sufficient to shear or dislodge the rib from the groove to permit further axial advancement of the compression member into the connector body. The flange may also have a diameter greater than the diameter of the internal bore at the second end of the connector body to limit or control the extent of the axial advancement of the compression member into the connector body.

The inner surface of the compression member includes a portion that is inwardly tapered from the first end toward the second end. As the compression member is axially advanced, the outer layers of the coaxial cable are compressed and held between the inner surface of the compression member and the sleeve of the post.

The outer surface of the compression member can include an annular groove at an intermediate portion between the external rib at the first end and the flange at the second end of the compression member. The outer surface may also include a shoulder between the annular groove and the flange that is sized to establish a press fit with the internal diameter of the second end of the connector body sufficient to retain the compression member in a second position fully axially advanced into the connector body. The annular groove may have side walls that can be inclined, perpendicular or radiussed. The annular groove provides for slight bending or flexure of the compression member to relieve the compressive stresses caused upon the axial advancement of the compression member and enables the connector to accommodate variations in the thicknesses of the foil layers, braided outer conductor and protective outer jacket of coaxial cables provided by assorted manufacturers.

In yet still further accordance with one or more exemplary aspects of the present invention, the device further includes or can further include one or more additional elements. Such elements can include, but are not limited to, (a) a sealing member such as an O-ring, disposed around the connector body adjacent to the port interface; (b) a covering element about the second end of the compression member; (c) a contact pin that has a first end adapted to engage a port of a piece of trunk line equipment, a second end for electrically engaging the center conductor of the coaxial cable, and an intermediate portion; (d) a collet at the second end of the contact pin which can include, if desired, a plurality of tines adapted to receive and retain the center conductor of the braided coaxial cable; and (e) one or more insulators disposed within the lumen of the connector body, and which electrically insulate the center contact pin and/ or collet from the connector body.

Still other aspects, embodiments and advantages of the present invention are discussed in detail below. Moreover, it is to be understood that both the foregoing general description and the following detailed description are merely illustrative examples of the present invention, and are intended to provide an overview or framework for understanding the nature and character of the invention as it is claimed. The accompanying drawings are included to provide a further understanding of the present invention, and are incorporated in and constitute a part of this specification. The drawings illustrate various embodiments of the invention, and together with the description serve to explain the principles and operations of the present invention.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION OF THE INVENTION

Figure 1:
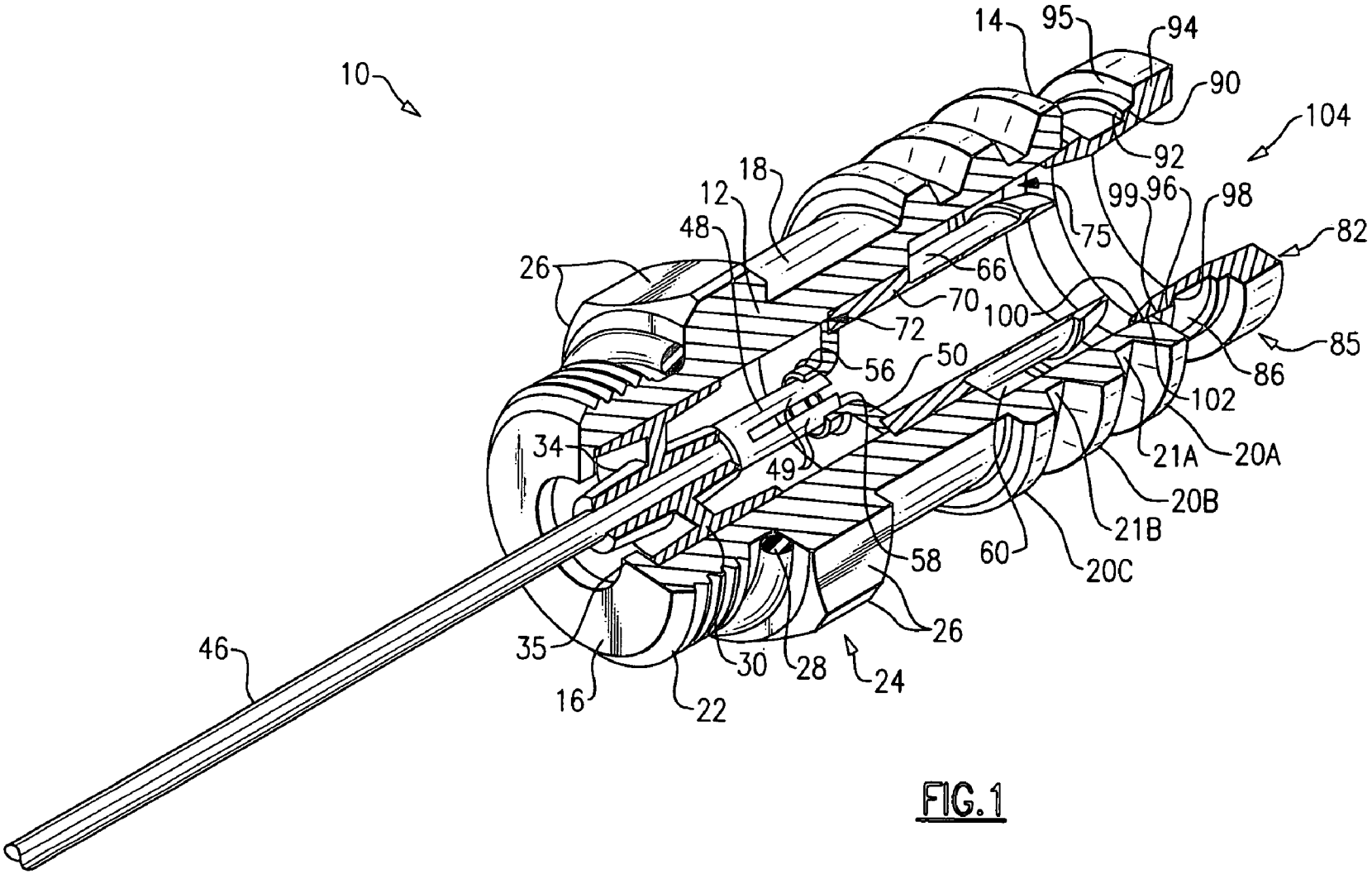
FIG. 1 is a cutaway perspective view of an exemplary embodiment of a braided coaxial cable connector of the present invention.
Figure 2:
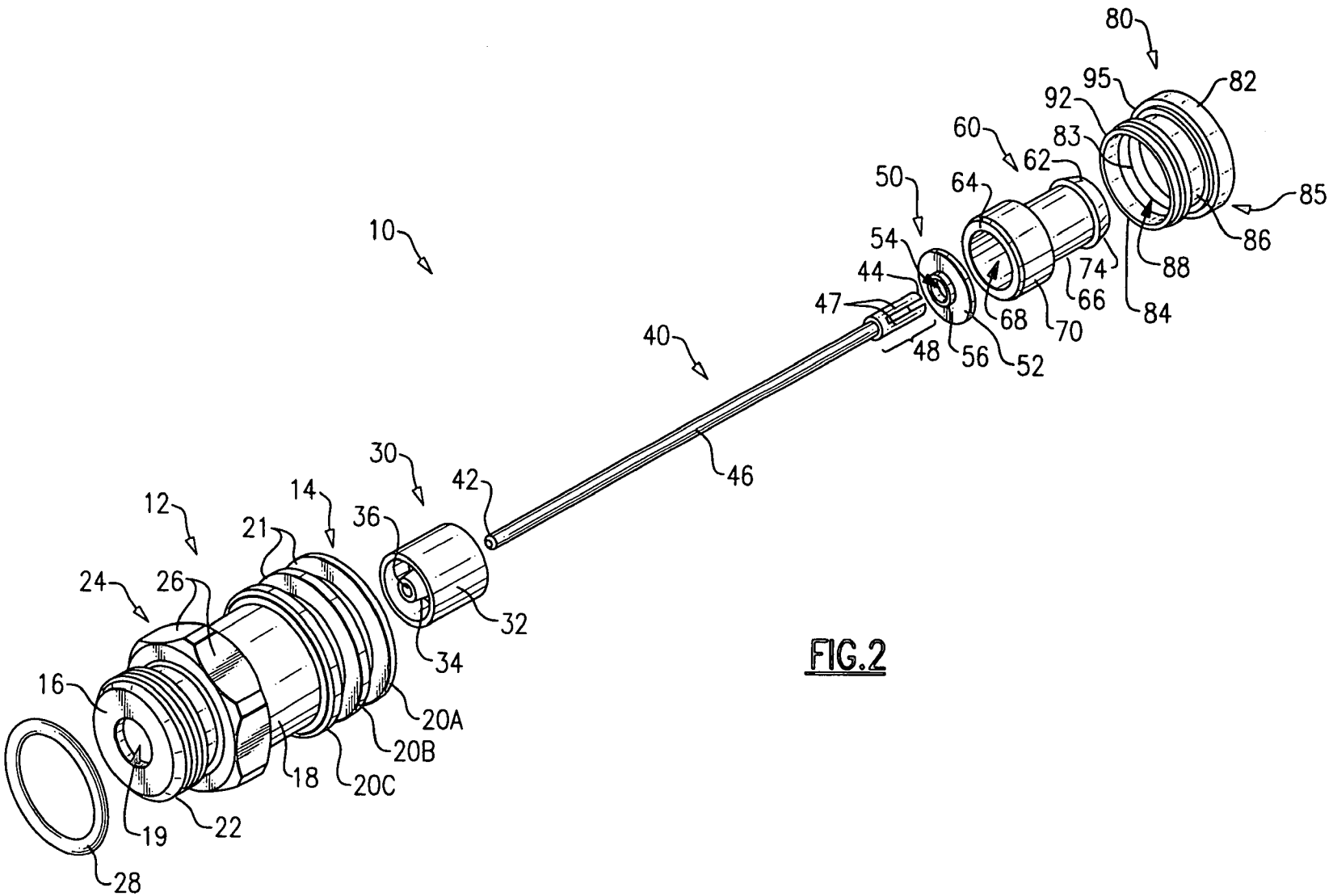
FIG. 2 is an exploded perspective view of the braided coaxial cable connector of FIG. 1.

Referring initially to FIGS. 1 and 2, a device 10 (e.g., a connector) is shown for interconnecting coaxial cable, such as coaxial cable within a communications network, to a trunk line equipment port. The device 10 of the present invention is highly advantageous because due to its structure and design, it is well suited for connecting coaxial cable (e.g., braided coaxial cable, especially large gauge braided coaxial cable as used within CATV networks) to the port of trunk line equipment (e.g., a tap, an amplifier, a filter, a trap, or the like) having a "KS" interface.

The connector 10 includes a connector body 12, which, according to an exemplary embodiment of the present invention and as shown in FIG. 2, has a generally cylindrical shape. The body 12 has a first end 16 and a second end 14 and a generally cylindrical intermediate portion 18. A plurality of protruding ridges 20A, 20B, 20C are provided between the second end 14 of the body 12 and the intermediary portion 18 and define recesses 21A and 21B therebetween. The protruding ridges include sidewalls that may be perpendicular or inclined relative to the outer surface of the connector body.

One or more of the protrusions 20A, 20B, 20C are engageable by a tool (not shown) in order to firmly grasp the connector body during the axially compression of the compression member into the connector body once a cable segment has been inserted therein. It is understood that the number, size, shape and/or specific location of the protrusions 20A, 20B, 20C can vary in accordance with the present invention, e.g., to ensure a proper fit with a compression tool. For example, according to some embodiments of the present invention, see, e.g., FIGS. 7 and 8, there is only one protrusion 20. Moreover, there need not be recesses 21A, 21B between the protrusions 20A, 20B, 20C, in which case the protrusions would not have a protruding shape/appearance. However, it is currently preferred for there to be two or more recesses 21A, 21B since that enables usage of less overall material, and, in turn, provides a cost savings.

A continuous internal bore/lumen 19 is defined between the first end 16 and the second end 14 of the connector body 12. The second end 14 of the connector body may include an internal groove 102. In accordance with an exemplary embodiment of the present invention, and as shown in FIG. 1, the lumen 19 has a first, substantially constant diameter from the first end 16 of the body 12 through the intermediate portion 18 of the connector body and a second, substantially constant diameter between the second end 14 of the connector body and the intermediate portion of the connector body (i.e., the portion of the lumen corresponding to the protrusions 20A, 20B, 20C). The multiple diameters within the internal bore create internal shoulder or step 72 within the internal bore for the engagement of the post and insulators and to provide sufficient annular space between the sleeve 66 of the post 60 and the connector body 12 to enable the connector 10 to accommodate a wide range of braided coaxial cable sizes from various manufacturers.

The connector body 12 also includes a port interface 22 and a nut portion 24, both of which generally are located between the intermediary portion 18 and the first end 16 of the connector body, wherein the nut portion generally is proximal to the port interface. The port interface 22, as shown, is a "KS" type of interface for enabling the connector 10 to connect a segment of braided coaxial cable to a trunk line equipment port (not shown). It is understood, however, that in accordance with the present invention the port interface 22 can also be a BNC, TNC, F, RCA, DIN male, DIN female, N male, N female connector, SMA male or SMA female type of interface if instead desired.

The nut portion 24 includes a plurality (typically six) of flats 26 for engagement (e.g., grasping) by a tool such as a wrench (not shown) in order to tighten the connector 10 to the trunk line equipment port via the port interface 22. In accordance with an exemplary embodiment of the present invention, and as shown in FIGS. 1 and 2, the diameter of the nut portion 24 is greater than that of the port interface 22. Although this is not a requirement of the present invention, it is currently preferred so as to facilitate grasping of the hexagonal flats 26 without damaging the port interface 22.

Figure 8:
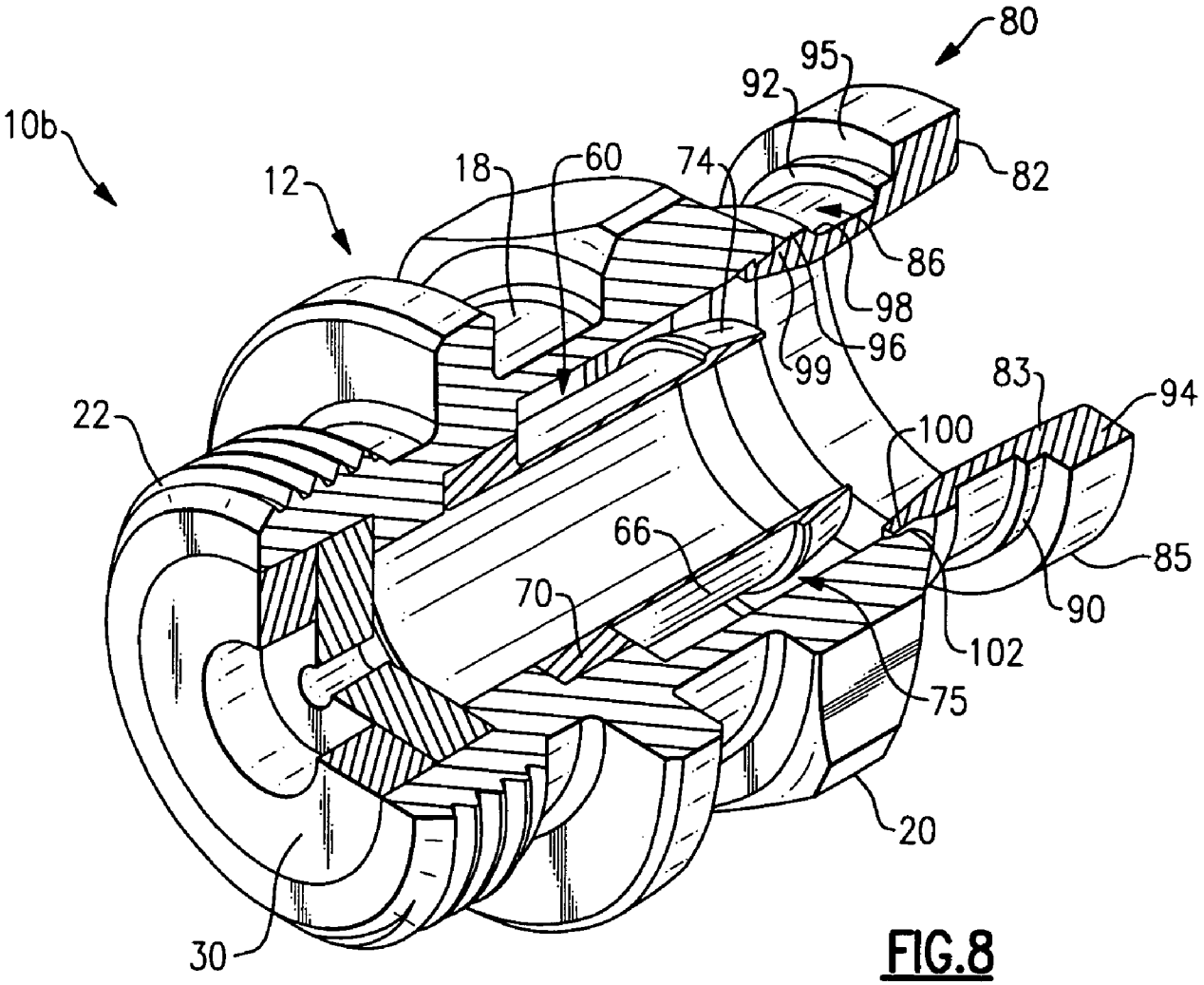
FIG. 8 is a cutaway perspective view of another alternate embodiment of the braided coaxial cable connector of the present invention.

As shown in FIGS. 1 and 2, the connector 10 can include a sealing element 28 disposed between the port interface 22 and the nut portion 24, e.g., against the nut portion. The presence of the sealing element 28 (e.g., an O-ring) is beneficial in that it provides added moisture resistance to the connector 10; however, the sealing element 28 can be omitted if desired, as shown in FIGS. 6B and 8.

The connector 10 further includes a forward insulator 30, a center conductor contact 40, a guide insulator 50 and a post 60, each of which is sized and shaped to fit within the internal lumen 19 of the connector body 12. The insulator 30 has a cylindrical outer shell 32 and an inner sleeve 34 disposed therewithin. As best shown in FIG. 1, the first end 16 of the connector body 12 includes a lip 35 having a diameter less than that of the outer shell 32 of the insulator 30 to ensure that the insulator can be inserted flush with the reduced inner diameter portion of the body and also to prevent inadvertent over-insertion thereof.

The inner sleeve 34 includes a center passageway 36 sized and shaped so as to accommodate the center conductor contact 40, which, as shown, is in the form of a conductive pin. The conductive pin 40 has a first end 42, a second end 44 and an intermediate portion 46. A collet 48 is disposed at the second end 44 of the conductive pin 40, wherein the outer diameter of the collet is greater than that of the central passageway 36 of the inner sleeve 34 such that the central passageway acts as a stop to ensure proper insertion of the conductive pin within the insulator 30. In accordance with an exemplary embodiment of the present invention, and as shown in FIGS. 1 and 2, the collet 48 includes a plurality of tines 49 to receive and retain the exposed end of the central conductor of the coaxial cable so as to pass the cable signal through the conductive pin 40 to the trunk line equipment port.

The connector may also include a guide insulator 50 which electrically isolates the collet 48 from the connector body 12. Another purpose of the guide insulator 50 is to facilitate proper insertion of the center conductor of an inserted cable segment into the tines 49 of the conductive pin 40. To that end, and in accordance with an exemplary embodiment of the present invention, the guide insulator 50 has an outer cylindrical shell 52 and an inner lumen 54, wherein a raised rim 56 is provided at the outer periphery of the lumen. As shown in FIG. 1, in an assembled connector 10 the tines 49 of the collet 48 of the conductive pin 40 fit within the lumen 54 and are seated against an internal shoulder 58 of the guide insulator 50 to prevent the conductive pin from being inadvertently moved following assembly of the connector 10.

The post 60 has a first end 64, a second end 62, and a sleeve portion 66. The post 60 has a generally cylindrical shape, wherein a lumen 68 is defined between its first end 64 and second end 62. As shown in FIG. 1, and in accordance with an exemplary embodiment of the present invention, the inner diameter of the lumen 68 is substantially constant so as to receive and protect the dielectric core of the coaxial cable.

The first end 64 of the post 60 includes a first increased diameter segment 70. According to an exemplary embodiment of the present invention, the outer diameter of the first increased diameter segment 70 is substantially constant. As shown in FIG. 1, when the connector 10 is assembled, the first increased diameter segment 70 is seated against the outer shell 52 of the guide connector 50 and maintained with the lumen 19 of the connector body 12 via a press fit against an internal shoulder or step 72. The post 60 further includes a barb 74 at or near the second end 62. According to an exemplary embodiment of the present invention, the barb 74 tapers inwardly toward the second end 62 of the post 60 to assist in engaging the braided outer conductor of the coaxial cable.

As shown in FIG. 1, and in accordance with an exemplary embodiment of the present invention, an annular space 75 is defined between the connector body 12 and the sleeve portion 66 of the post 60, wherein the annular space receives the outer protective jacket and braided wire sheath of the coaxial cable.

The connector 10 further includes a compression member 80 which has a first end 84, a second end 82, an inner surface 83 and an outer surface 85. A continuous lumen 88 is formed between the first and second ends of the compression member 80. In the preferred embodiment of the invention, the compression member is formed of a deformable plastic material such as acetyl resin, commonly known under the trade name Delrin®. The first end 84 of the compression member can include a protruding rib 100. The rib 100 is configured to mate or slidingly engage with an internal groove 102 inside of the second end 14 of the connector body 12 so as to retain the compression member 80 in a first assembled but non-compressed position shown in FIG. 1. In this first position a properly prepared end of a coaxial cable (see FIG. 3) may be inserted through an the opening 104 at the second end 82 of the compression member and into the lumen 19 at the second end 14 of the connector body 12. The rib 100 is geometrically configured with a forward inclined sidewall to assist in the axial advancement of the compression member 80 into the connector body 12, yet also with a perpendicular rearward sidewall so as to inhibit unintended removal of the compression member from the connector body. The height of the rib and its geometric configuration (e.g. inclination of its forward and rearward sidewalls) can be varied to achieve the desired ease of assembly and detachment of the compression member from the connector body, as taught in U.S. Pat. No. 5,470,257 (see col. 4, ll. 22–31 and col. 5, ll. 44–55), which is incorporated herein by reference.

The second end 82 of the compression member is configured to be engaged by the compression tool (not shown) which will slidably axially advance the first end of the compression member further into the internal bore of the connector body 12. The second end of the compression member further includes a flange 94 having a diameter greater than the internal diameter at the second end of the connector body 12. The forward sidewall 95 of the flange acts as a stop to limit the axial advancement of the compression member into the connector body during installation of the connector on a cable segment.

The outer surface 85 of the compression member 80 includes an annular groove 86 between the first end 84 and the flange 94. According to an exemplary embodiment of the present invention, the annular groove has sidewalls 92 and 98 that can be perpendicular to the outer surface as is sidewall 92, inclined as is sidewall 98 or otherwise radiussed. A first annular shoulder 96 is formed on the compression member between the first end 84 and the annular groove 86. The diameter of the first annular shoulder 96 is only slightly less than the internal diameter of the second end 14 of the connector body to assist in maintaining a straight axial insertion of the compression member into the connector body. A second annular shoulder 90 is defined on the outer surface 85 between the annular groove 86 and the flange 94. The outer diameter of the second shoulder 90 is sized and configured to establish a press fit with the internal diameter of the second end 14 of the connector body 12. The press fit retains the compression member in the connector body sufficient to withstand the tensile forces on the cable segment without separation from the connector.

The inner surface 83 of the compression member 80 has an arcuate shape/profile. According to an exemplary embodiment of the present invention, at least a portion of the inner surface 83 of the compression member 80 tapers inwardly from the first end 84 toward the 84 second end 82 of the compression member 80.

Figure 3:
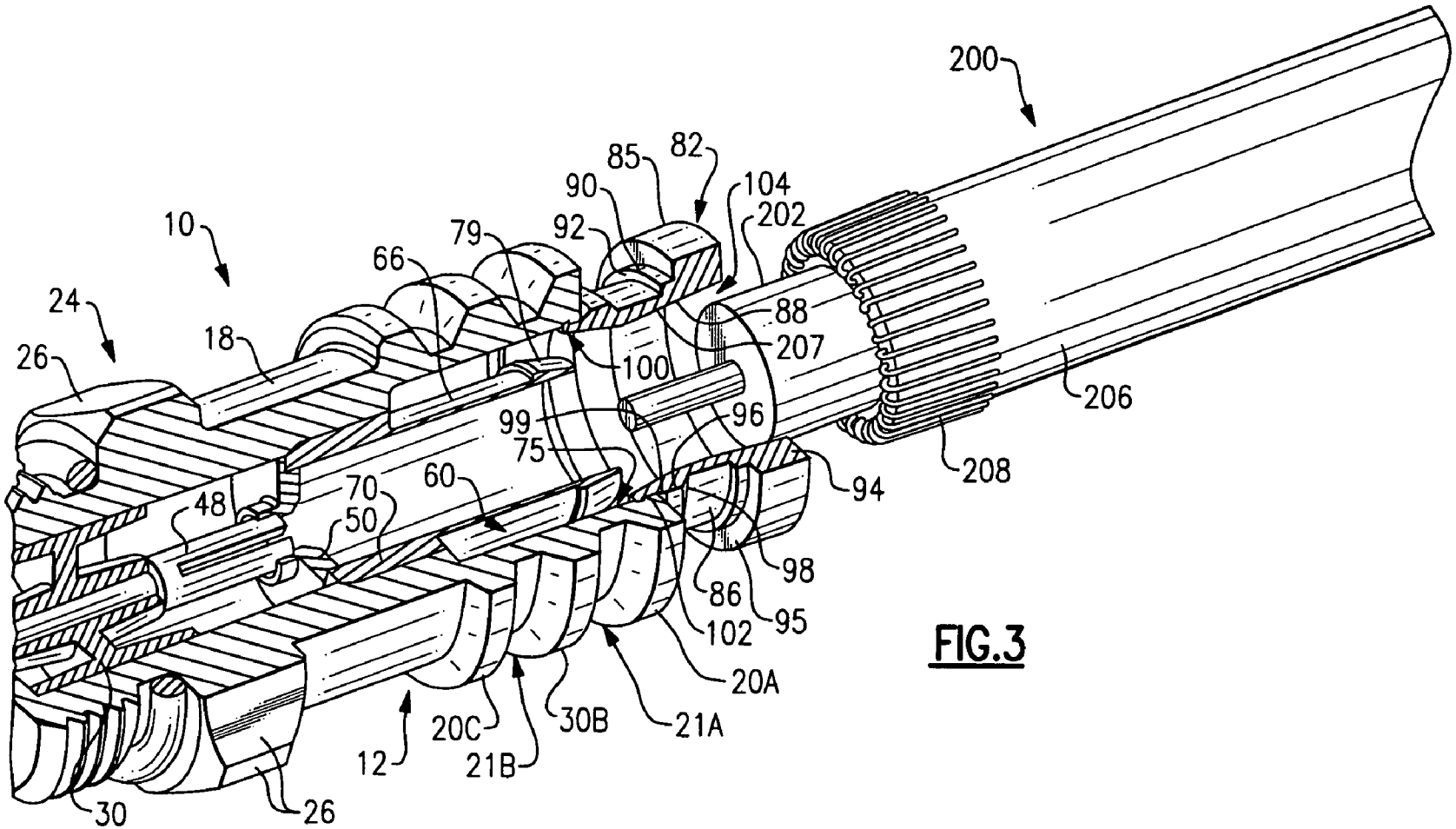
FIG. 3 is a cutaway perspective view of the braided coaxial cable connector of FIG. 1 as a braided coaxial cable segment is being inserted therein.

Referring now to FIG. 3, a segment of braided coaxial cable 200 is depicted as it is being initially inserted within the proximal opening 104 of the connector 10 of FIGS. 1 and 2. The cable 200 includes a central conductor 204 surrounded by a dielectric core 202. A braided outer conductor 208 surrounds the dielectric core 202 and is folded over a portion of an outer protective jacket 206 of the cable 200. To render the cable 200 as it appears in FIG. 3 and such that it is capable of proper insertion into the connector 10, various layers of the cable are selectively removed to progressively expose an end of the center conductor 204 and an end of the dielectric core 202, after which an end portion of the braid conductor 208 is folded over the outer jacket 206. Although not shown in FIG. 3, the cable 200 can have one or more foil layers and/or wire sheaths forming the braided outer conductor to provide additional shielding of the signal carried on the central conductor.

Referring now to FIG. 3, a segment of braided coaxial cable 200 is depicted as it is being initially inserted within the proximal opening 104 of the connector 10 of FIGS. 1 and 2. The cable 200 includes a central conductor 204 surrounded by a dielectric core 202. A braided outer conductor 208 surrounds the dielectric core 202 is folded over a portion of an outer protective jacket 206 of the cable 200. To render the cable 200 as it appears in FIG. 3 and such that it is capable of proper insertion into the connector 10, various layers of the cable are selectively removed to progressively expose an end of the center conductor 204 and an end of the dielectric core 202, after which an end portion of the braid conductor 208 is folded over the outer jacket 206. Although not shown in FIG. 3, the cable 200 can have one or more foil layers and/or wire sheaths forming the braided outer conductor to provide additional shielding of the signal carried on the central conductor.

Figure 5:
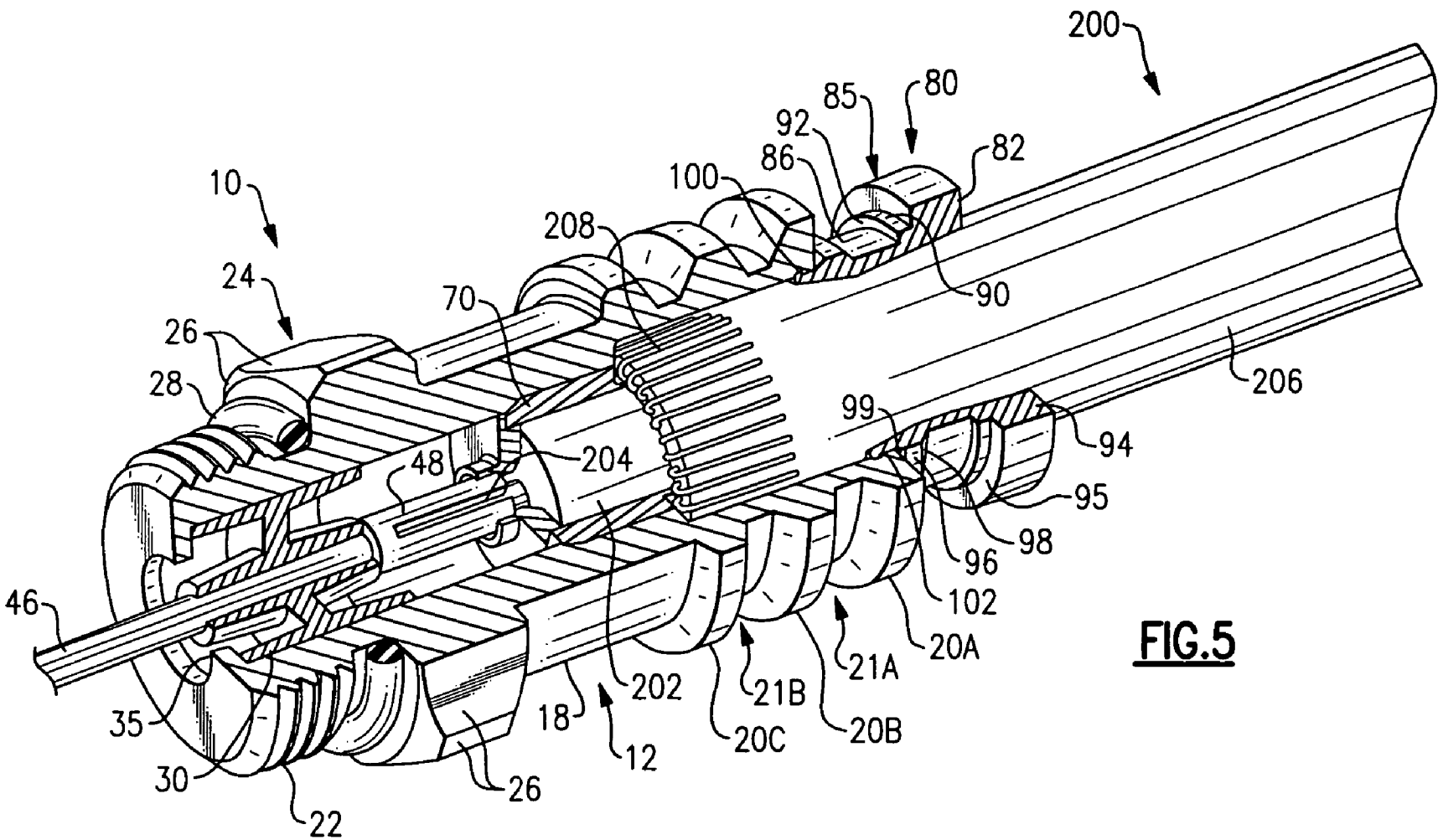
FIG. 5 is a cutaway perspective view of the braided coaxial cable connector of FIG. 1 in an assembled but uncompressed state after the braided coaxial cable segment of FIG. 3 has been fully inserted therein.

Following still further insertion of the cable 200, and as depicted in FIG. 5, the sleeve 66 of the post 60 is fully inserted between the core 202 and the braid conductor 208. Moreover, the center conductor 204 has been fed into and though the guide insulator 50 and into the collet 48 at the second end of the conductive pin 40. At this stage of insertion, the compression member 80 is generally in contact with, but is not yet compressing the outer protective jacket 206 of the cable 200.

Figure 6A:
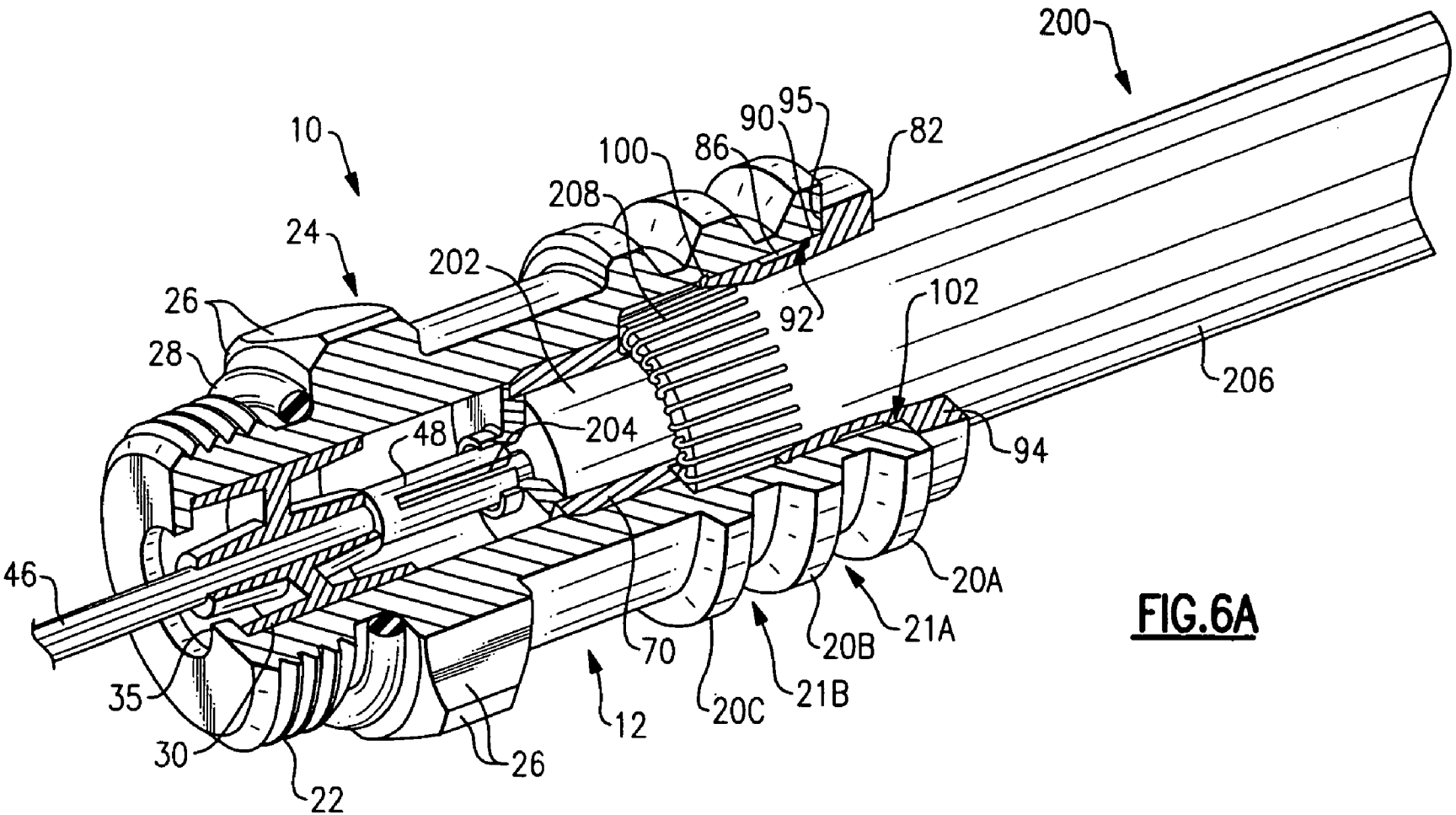
FIG. 6A is a cutaway perspective view of the braided coaxial cable connector of FIG. 1 in a compressed state with the braided cable segment of FIG. 3 therein.
Figure 6B:
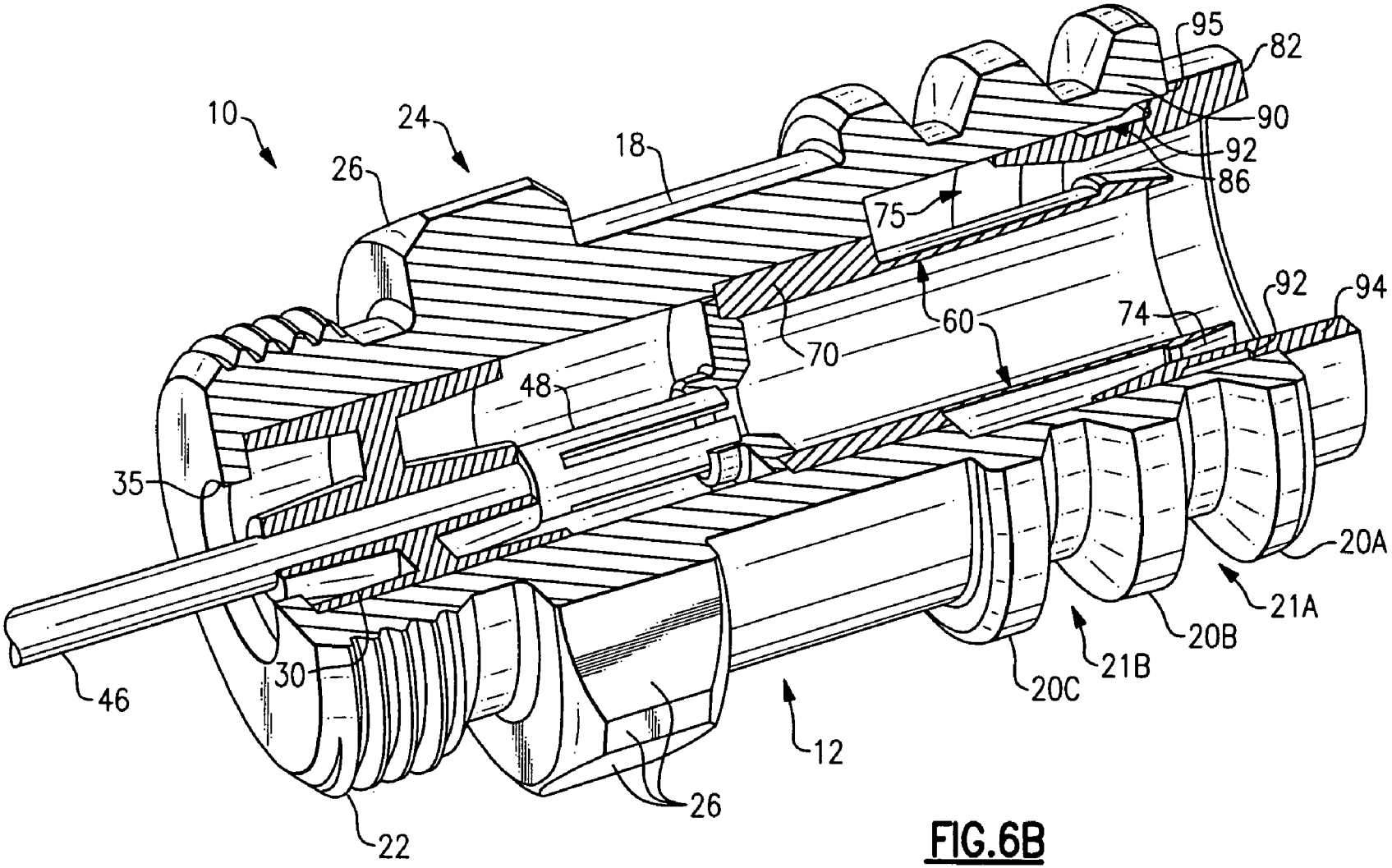
FIG. 6B is a cutaway perspective enlarged view of the coaxial cable connector of FIG. 6A.

Turning now to FIGS. 6A and 6B, the connector 10 is shown in a compressed state, having the compression member fully axially advanced by a compression tool (not shown) following complete insertion of the cable as shown in FIG. 5. By way of non-limiting example, the compression tool can grasp or otherwise engage one or more of the protrusions 20A, 20B, 20C of the connector body 12 as well as the second end 82 of the compression member 80 so as to slidingly axially advance the compression member 80 and into the body 12.

As the compression member 80 is axially moved in a forward direction, the rib 100 is dislodged from the groove 102 at the second end 14 of the connector body 12. Upon further advancement, the first annular 96 cooperates with the interior surface at the second end of the connector body to maintain a straight axial advancement of the compression member into the connector body.

As axial advancement continues, the inwardly tapered portion of the interior surface 83 of the compression member 80 exerts inwardly radial forces upon the inserted segment of cable 200. The inwardly tapered portion of the interior surface compresses and traps the braided outer conductor 208 and the protective outer jacket 206 of the cable 200 between the inner surface 83 of the compression member 80 and sleeve 66 of the post 60. The compression member continues to be axially advanced into the second end 14 of the connector body 12 until the annular shoulder 90 becomes firmly pressed into the second end 14 of the connector body or until the sidewall 95 of the flange 94 abuts the second end 14 of the connector body.

While the compression member 80 exerts radial force against the outer jacket 206 of the cable 200, a secure connection is maintained between the cable 200 and the connector 10. As noted above, the presence of the groove 86 is beneficial because it provides important radial flexibility and stress relief during the compression process and enables the connector 10 to accommodate variations in the thicknesses of the foil, braided outer conductors and protective outer jackets of cables from various manufacturers.

Figure 7:
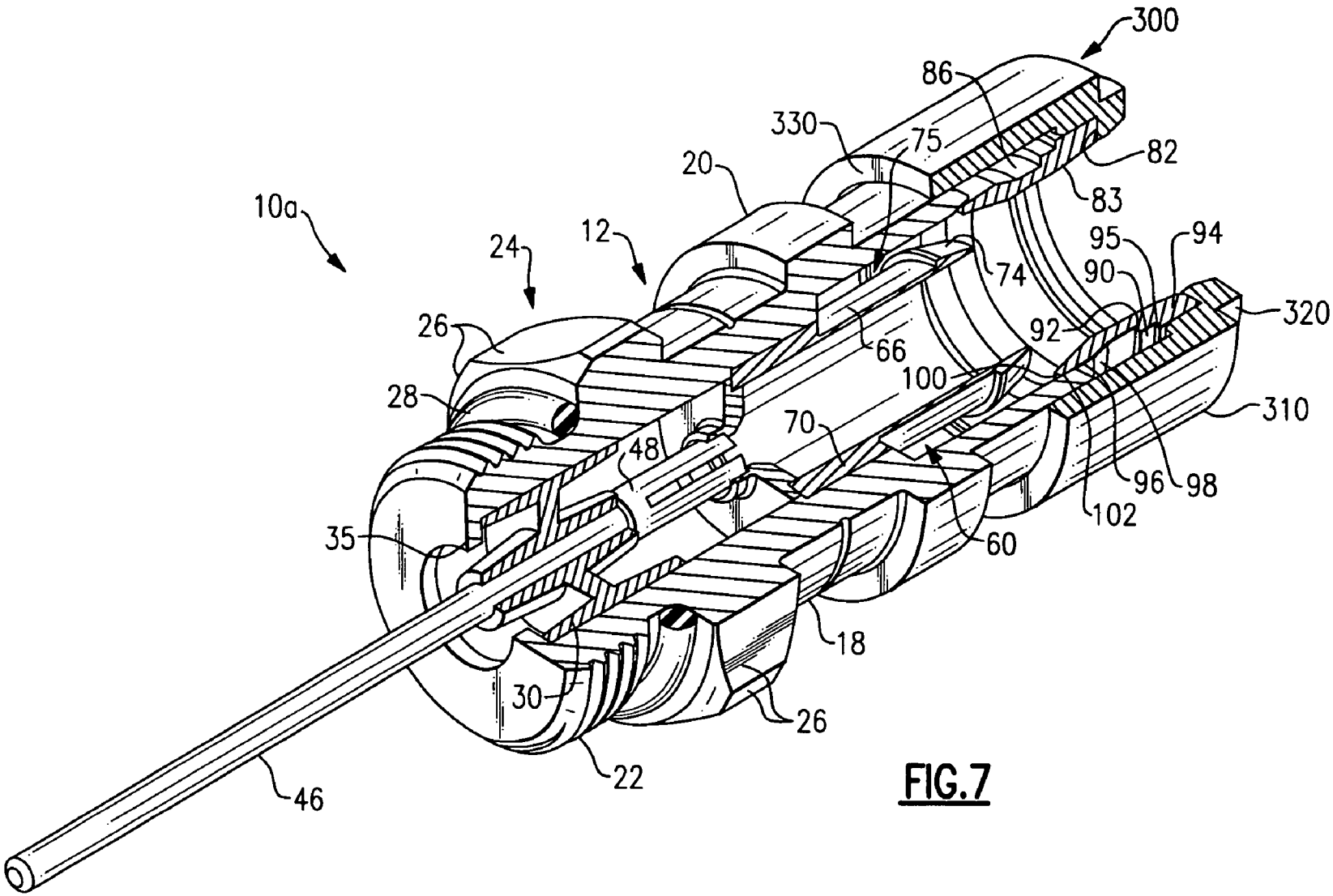
FIG. 7 is a cutaway perspective view of an alternate embodiment of the braided coaxial cable connector of the present invention.

FIGS. 7 and 8 depict two alternate embodiments of the present invention. In FIG. 7, the connector 10*a* includes a covering element 300 made of a durable material (e.g., metal) that surrounds or encloses the second end of the compression member 80, which is usually made of a comparatively less durable material (e.g., plastic). Thus, the covering element 300 protects the compression member 80 during and after installation and shields it from the effects of light and the environment.

According to another exemplary embodiment of the present invention, the covering element 300 has a cylindrical body 310 and a flanged proximal end 320 shaped to fit around the flange 94 of the compression member 80. The distal end 330 of the covering element 300 fits atop the connector body 12. The covering element 300 can be placed in communication with the connector 10 via several techniques; however, in accordance with an exemplary embodiment of the present invention, the covering element is press fit onto the connector body 12 and around the flange 94 of the compression member.

Referring now to FIG. 8, another alternate embodiment of a connector 10*b* of the present invention is shown. In this embodiment, the connector 10*b* is a "feed through" wherein the connector does not include a conductive pin, and its insulator 30 does not have a collet 48. Thus, when a cable segment 200 is inserted into the connector 10*b*, the protruding portion of the central conductor 204 of the cable will be flush with the insulator, and the exposed segment of the cable will be emerge from the first end 16 of the connector body 12. This embodiment provides several comparative benefits versus those of FIGS. 1–7, including but not limited to, cost savings, improved corrosion resistance and ease of installation.

In sum, usage of the connectors 10, 10*a*, 10*b* of the present invention entails connecting the connector to a trunk line equipment port via the port interface 22 (e.g., by using a tool to tighten the hexagonal flats 26 on the nut portion 24 of the connector body 12), then inserting a segment of braided coaxial cable 200 into the port via the connector (as shown in FIGS. 3–5 and 6A, and as discussed above), and then using a tool to firmly grasp the connector body 12 (e.g., by engaging and pressing upon the protrusions 20) and to axially advance the compression member 80 into a second compressed forward position. Thus, use of the connector 10, 10*a*, 10*b* of the present invention entails simple steps and does not require an adapter, which, as noted above, is normally required to connect braided coaxial cable to trunk line equipment ports. Moreover, proper installation of the connectors 10, 10*a*, 10*b* also do not require the use of a swivel joint. That, in turn, enables the connector 10 to function as a permanent affixture whereby it provides a more secure connection and exhibits increased tamper resistance as compared to easily reversible connectors that employ a swivel joint or the like.

Although the present invention has been described herein with reference to details of currently preferred embodiments, it is not intended that such details be regarded as limiting the scope of the invention, except as and to the extent that they are included in the following claims—that is, the foregoing description of the present invention is merely illustrative, and it should be understood that variations and modifications can be effected without departing from the scope or spirit of the invention as set forth in the following claims. Moreover, any document(s) mentioned herein are incorporated by reference in their entirety, as are any other documents that are referenced within the document(s) mentioned herein.

I claim:

1. A coaxial cable connector comprising:

a connector body having a first end, a second end, an exterior surface, an interior surface defining an internal bore, said first end of the connector body having a port interface, and said exterior surface having a protruding ridge configured for engagement by a compression tool;

a post sized and configured for engagement with the connector body at a portion of the internal bore; and a compression member having a first end sized and configured for insertion into the second end of the connector body, a second end configured for engagement by a compression tool, an interior surface including an inwardly tapered portion and an exterior surface including a pair of annular shoulders sized and configured to be press fit into the second end of the connector body and an annular groove between the pair of shoulders;

wherein, upon sliding axial advancement of the compression member into the second end of the connector body by a compression tool, at least one of the annular shoulders is press fit into the second end of the connector body and the tapered inner surface of the compression member compresses and holds a braided outer conductor and a protective outer jacket of a coaxial cable between the compression member and the post.

2. The coaxial cable connector of claim 1, wherein the port interface includes external threads on the first end of the connector body.

3. The coaxial cable connector of claim 2 wherein the exterior surface of the connector body includes flats for engagement with a tool.

4. The coaxial cable connector of claim 3 wherein the connector body includes a sealing element disposed around the connector body between said external threads and said flats.

5. The coaxial cable connector of claim 4, wherein the sealing element is an O-ring.

6. The coaxial cable connector of claim 1 further comprising a contact pin having an end that includes a collet for receiving a center conductor of a coaxial cable and an insulator having an external diameter disposed between said contact pin and said connector body.

7. The coaxial cable connector of claim 6 wherein said first end of said connector body includes an inwardly directed lip having an inner diameter smaller than the external diameter of the insulator.

8. The coaxial cable connector of claim 6 further comprising a guide insulator disposed between said collet and said connector body.

9. The coaxial cable connector of claim 1 wherein the second end of the compression member includes a flange configured for engagement by a compression tool.

10. The coaxial cable connector of claim 9 wherein the second end of the connector body includes an interior groove and the first end of the compression member includes an exterior rib that engages said interior groove to define a first position of said compression member wherein a prepared end of a coaxial cable can be inserted through the compression member and into said second end of the connector body.

11. The coaxial cable connector of claim 10 wherein, upon axial advancement of the compression member further into said connector body, said rib is dislodged from said groove.

12. The coaxial cable connector of claim 9, further comprising:

a covering element having a proximal end and a distal end and being positioned over the second end of the compression member.

13. The coaxial cable connector of claim 12, wherein the distal end of the covering member is positioned over the second end of the connector body.

14. A coaxial cable connector comprising:

a connector body defining an internal bore and having a first end having external threads and hexagonal flats, and a second end, said connector body having at least one protruding ridge configured for the engagement of a compression tool;

a post sized and configured for engagement with the connector body at a portion of the internal bore, said post having a sleeve configured for engagement with a portion of a braided coaxial cable; and a compression member having a first end with an external rib configured to engage an internal groove in the connector body, a second end having a flange configured for engagement by a compression tool, a tapered inner surface and an outer surface including an annular groove defined between the rib and the second end and an annular shoulder disposed between the groove and the flange said shoulder sized and configured to be press fit into the second end of the connector body.

15. The coaxial cable connector of claim 14 wherein the second end of the connector body has the internal groove and the first end of the compression member has an external rib configured to engage said internal groove to define a first position wherein the compression member is retained at the second end of the connector body for receiving a coaxial cable.

16. The coaxial cable connector of claim 14 further comprising a contact pin having an end that includes a collet for receiving a center conductor of a coaxial cable and an insulator having an external diameter said insulator disposed between said contact pin and said connector body.

17. The coaxial cable connector of claim 16 wherein said first end of said connector body includes an inwardly directed lip having an inner diameter smaller than the external diameter of the insulator.

18. The coaxial cable connector of claim 16 further comprising a guide insulator disposed between said collet and said connector body.

19. The coaxial cable connector of claim 14 further comprising a covering element having a proximal end and a distal end and disposed over the compression member.

20. The coaxial cable connector of claim 16 wherein, upon axial advancement of the compression member into the second end of the connector body, a braided outer conductor and an outer protective jacket of a coaxial cable are compressed and held between the tapered inner surface of the compression member and the post.

21. The coaxial cable connector of claim 16 wherein said post has a second end including a barb.

22. The device of claim 20, wherein the proximal end of the covering member is positioned around the proximal end of the compression member and wherein the distal end of the covering member is positioned on the proximal end of the connector body.

23. The device of claim 14, wherein the second end of the connector body includes a plurality of protruding ridges configured for engagement by a compression tool.

* * * * *

UNITED STATES PATENT AND TRADEMARK OFFICE

CERTIFICATE OF CORRECTION

PATENT NO. : 7,217,155 B2
APPLICATION NO. : 11/317704
DATED : May 15, 2007
INVENTOR(S) : Noah Montena It is certified that error appears in the above-identified patent and that said Letters Patent is hereby corrected as shown below:

On the title page item (73), Assignee. Delete the words "John Mezzalinaqua Associates, Inc." and replace with --John Mezzalingua Associates, Inc.--

Figure 4:
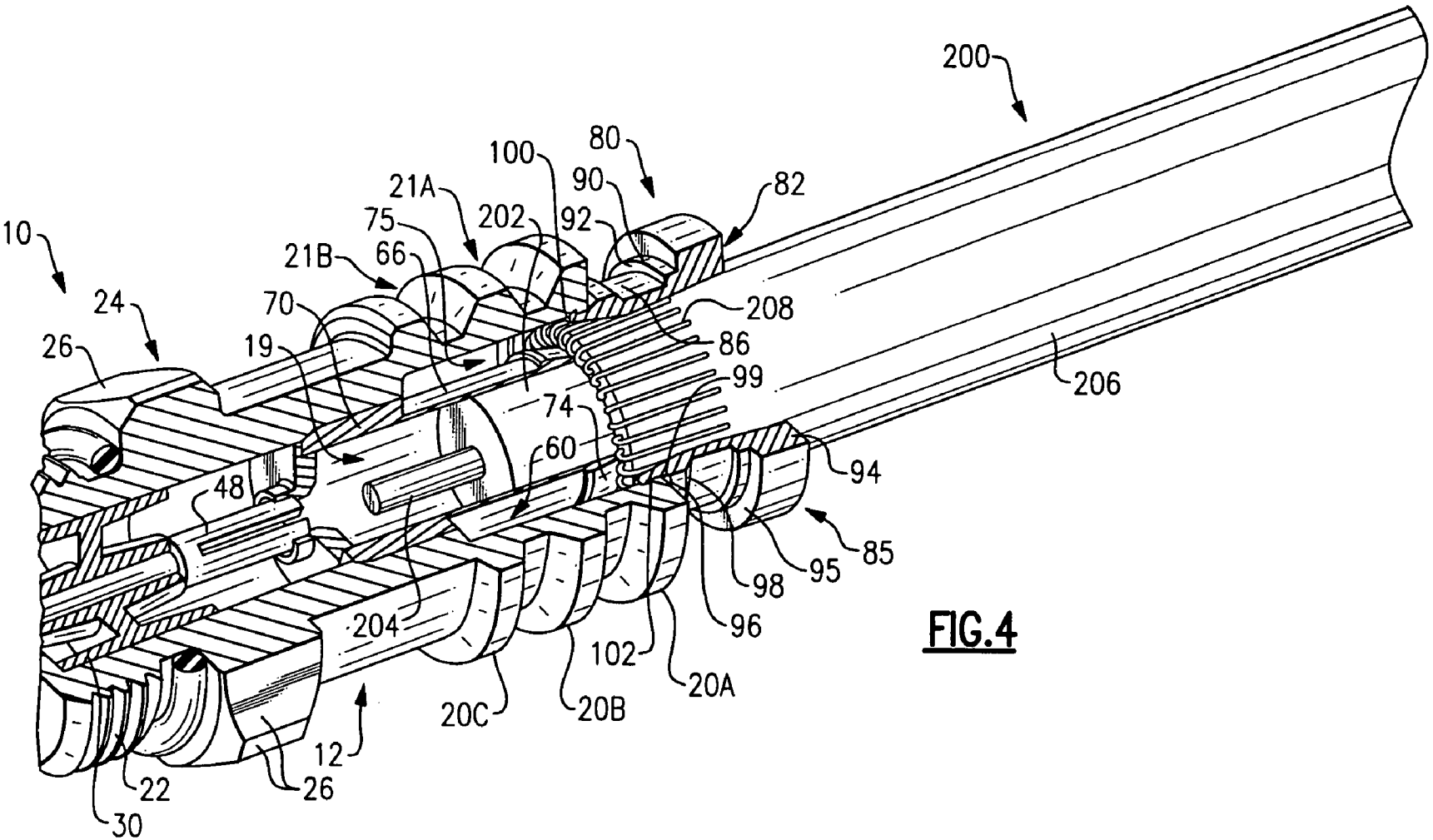
FIG. 4 is a cutaway perspective view of the braided coaxial cable connector of FIG. 1 as the braided coaxial cable segment of FIG. 3 is further inserted therein.

Col. 8, Lines 20 through 36 should be deleted in their entirety and replaced with --Referring now to Figure 4, the cable 200 has been further inserted within the connector 10 such that the dielectric core 202 is within the lumen 19 of the connector body 12 and a portion of the central conductor 204 of the cable is within the sleeve 66 of the post 60. As this further insertion occurs, the folded end portion 208 of the braid conductor slides over the tapered end of the barb 74 of the post 60 such that the barb in inserted between the dielectric core 202 and the braided outer conductor 208.--

Col. 8, Line 41. The words "though the guide" should be deleted and replaced with --through the guide--.

Signed and Sealed this

Twenty-fourth Day of July, 2007

JON W. DUDAS
*Director of the United States Patent and Trademark Office*